US006049314A

United States Patent [19]

Munson et al.

[11] Patent Number: 6,049,314

[45] Date of Patent: Apr. 11, 2000

[54] WIDE BAND ANTENNA HAVING UNITARY RADIATOR/GROUND PLANE

[75] Inventors: Robert Eugene Munson; Joseph Theofil Negler, both of Boulder, Colo.

[73] Assignee: Xertex Technologies, Inc., Broomfield, Colo.

[21] Appl. No.: 09/193,781

[22] Filed: Nov. 17, 1998

[51] Int. Cl.[7] ..... H01Q 1/48; H01Q 1/38

[52] U.S. Cl. ..... 343/846; 343/700 MS

[58] Field of Search ..... 343/700 MS, 795, 343/828, 829, 830, 846, 848, 906; 29/600

[56] References Cited

U.S. PATENT DOCUMENTS

| | | | |
|---|---|---|---|
| 4,835,541 | 5/1989 | Johnson et al. | 343/713 |
| 4,867,552 | 9/1989 | Zakman | 343/700 MS |
| 5,355,142 | 10/1994 | Marshall et al. | 343/700 MS |
| 5,444,453 | 8/1995 | Lalezari | 343/700 MS |
| 5,532,707 | 7/1996 | Klinger et al. | 343/793 |

*Primary Examiner*—Hoanganh Le
*Assistant Examiner*—Tan Ho
*Attorney, Agent, or Firm*—F. A. Sirr; E. C. Hancock; Holland & Hart LLP

[57] ABSTRACT

An antenna is formed from a single sheet of generally planar metal that is cut to provide four geometric antenna shapes that comprise a ground plane element, a two-section shorting element that is defined by two generally parallel fold lines, a radiating element, and an arm that has one end fixed to a generally central portion of the radiating element and has a free end that extends toward a fold line. Folding the metal sheet on the two fold lines positions the radiating element above the ground plane element. A transmit/receive coaxial cable is aligned with a gap that is formed between the two sections of the shorting element. The cable's outer metal sheath is connected to a metal tab, and the metal tab is secured to a surface of the ground plane element. The cable's center conductor is secured to a surface of the radiating element. A radome and its mounting tab complete the antenna assembly.

21 Claims, 3 Drawing Sheets

WIDE BAND ANTENNA HAVING UNITARY RADIATOR/GROUND PLANE

CROSS-REFERENCE TO RELATED APPLICATIONS

This application relates to U.S. Pat. No. 5,734,350, issued on Mar. 31, 1998, which patent is incorporated herein by reference.

An antenna in accordance with this invention may be used to good advantage with the radome that is taught by copending PCT Patent Application PCT/US97/05716, filed Apr. 8, 1997, specifying the United States as a continuation in part application, which application is incorporated herein by reference.

BACKGROUND OF THE INVENTION

1. Field of the Invention

The present invention relates to receiving and transmitting antennas. More particularly, the present invention relates to RF antennas having a relatively low physical volume profile. While not limited thereto, the present invention is particularly useful for high frequency RF signal exchanges at relatively low power and over short ranges.

2. Description of the Related Art

Several varieties of flat Radio Frequency (RF) antennas have evolved in the past.

U.S. Pat. No. 4,835,541 to Johnson et al provides a quarter wavelength microstrip antenna structure that includes a thin conductive copper sheet that is folded over to form the shape of the letter "U". The copper sheet, thus folded, provides an upper radiating surface section that defines a first conductive surface, a lower ground plane section that is parallel to the first section and defines a second conductive surface, and a shorting section that connects the upper and lower sections, with the upper and lower sections each meeting the shorting section at a right angle. The cavity that is defined by the upper section and the lower section is a quarter wavelength resonant cavity. A hole is drilled through the shorting section, and a coaxial cable is passed through the hole. The outer cable sheath is electrically connected to the lower section and the center cable conductor is connected to the upper section, and in one embodiment this latter connection is provided by way of an impedance matching network. The shorting section electrically connects the lower section to an edge of the upper section, thus this upper section edge is at the same potential as the lower section.

U.S. Pat. No. 5,355,142 by Marshall et al provides a quarter wave microstrip antenna having a ground plane member and a microstrip element that are generally of the same physical area, and are arranged in a mutually parallel configuration so as to define a dielectric space therebetween. The microstrip element has a length that is approximately one quarter the wavelength of the center frequency at which the antenna operates. Since the antenna is a quarter wave microstrip antenna, the microstrip element includes an L-shaped shorting element by which one edge of the microstrip element is mounted to one edge of the ground plane member by way of four metal screws that establish electrical and mechanical connection between the microstrip element and the ground plane member. A center portion of the microstrip element is cut so that a feed member may be bent downward at generally a right angle; i.e., the feed member is bent in the direction of the ground plane member. A transmission line is held by the above-described four screws and extends into the dielectric space between the microstrip element and the ground plane member. The transmission line includes a first electrical conductor that is connected to the ground plane member and a second electrical conductor that is connected to the feed member of the microstrip element.

U.S. Pat. No. 5,444,453 by Lalezari describes a parallel plate, inverted, microstrip type of antenna using air as a dielectric and intended to operate in the 10 to 40 gigaHertz range. A relatively large dielectric plate (i.e., 1×1 to 2×2 inch square or one to two inch diameter circular plates) supports a smaller metallic radiator patch centrally located over a metallic ground plane member that is about the same size as the dielectric plate. A number of support posts of substantially the same height maintain a 0.1 mm to 1.0 mm spacing between the dielectric plate and the ground plane member.

U.S. Pat. No. 5,532,707 to Klinger et al provides a directional dipole antenna wherein four dipole elements and their individual symmetrizer legs are stamped out of the material of a reflector. The four L-shaped dipole/symmetrizer units are then bent upward from the plane of the reflector by an angle of 30 to 60 or 90-degrees. In this way, the plane of the reflector meets the planes of the four L-shaped dipole/symmetrizer units to form a V-shape.

SUMMARY OF THE INVENTION

This invention finds utility in a wide variety of antennas and antenna applications, and is especially useful for the specialized needs of wireless communication equipment, such as for operating in the unlicensed (U.S.A.) 902–928 MHz frequency band. An embodiment of this invention advantageously utilizes a radiating element that is oriented at an angle relative to a ground plane element, as is describe in the above-mentioned related United States patent.

An antenna in accordance with the spirit and scope of this invention is formed from a single sheet of generally planar metal that is stamped, cut, or formed, and then bent, to provide four functional shapes in one unitary metal assembly.

These four functional shapes comprise a ground plane element, a radiating element that is physically spaced from or above the ground plane, a two-section shorting element that is joined to the radiating element and to the ground plane element by two generally parallel fold lines, and an arm that has one end fixed to a generally central portion of the radiating element and has a free end that extends toward a shorting element fold line.

Folding or bending this metal sheet on the above-described two fold lines provides that the radiating element may be positioned parallel to, or at an angle to, the ground plane element.

A transmit/receive feed line, for example a coaxial cable, is aligned with a gap that is formed in the two-section shorting element. One conductor of this feed line connects to the ground plane element (for example, the outer metal sheath of a coaxial cable), while a second conductor of the feed line (for example, the center conductor of a coaxial cable), connects to the radiating element and, for example, this second conductor connects to the above-described extending arm that is formed unitary with the radiating element.

As a feature of the invention, and when the transmit/receive feed line comprises a coaxial cable, that cable has an outer metal sheath which is connected to a T-shaped metal connector tab by bending the arms of the T around the cable metal sheath, and then securing the T arms thereto, such as by the use of solder, welding, electrically conductive glue, or the like. The extending leg of this T-shaped connector tab is then secured, or soldered, to the top or bottom surface of the ground plane element, as the cable's center conductor is secured to the top or bottom surface of the radiating element.

Impedance matching of the antenna to the transmit/receive feed line/cable is achieved by a unique construction and arrangement of the above-described arm whose one end is fixed to a generally central portion of the radiating element, and whose free end extends toward a shorting element fold line.

Those having normal skill in the art will recognize the foregoing and other objects, features, advantages and applications of the present invention from the following more detailed description of the preferred embodiments as illustrated in the accompanying drawings.

DESCRIPTION OF THE PREFERRED EMBODIMENT

A microstrip antenna in accordance with the present invention has a minimum number of parts, has a lower cost, has better reliability, has a higher gain, has an increased bandwidth, and has a lower weight, as compared to contemporary antennas.

Figure 1:
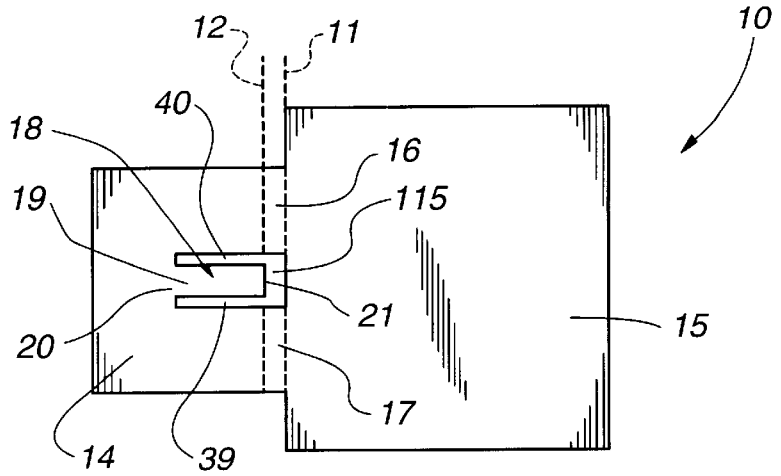
FIG. 1 is a top view of a flat sheet of metal, for example copper, that has been stamped, cut, or formed to provide four functional shapes of an antenna in accordance with this invention within one unitary metal assembly, and wherein two parallel and dotted lines define two fold lines.

FIG. 1 is a top plan view of a flat sheet 10 of a metal, such as copper, but without limitation thereto, that is about $1/64^{th}$-inch thick and has been stamped, cut, or formed to provide four functional shapes of an antenna in accordance with this invention within the one unitary metal sheet 10.

In FIG. 1, two parallel dotted lines 11, 12 define two fold lines about sheet 10 is bent or folded to a generally U-shape, as will be described.

Figure 2:
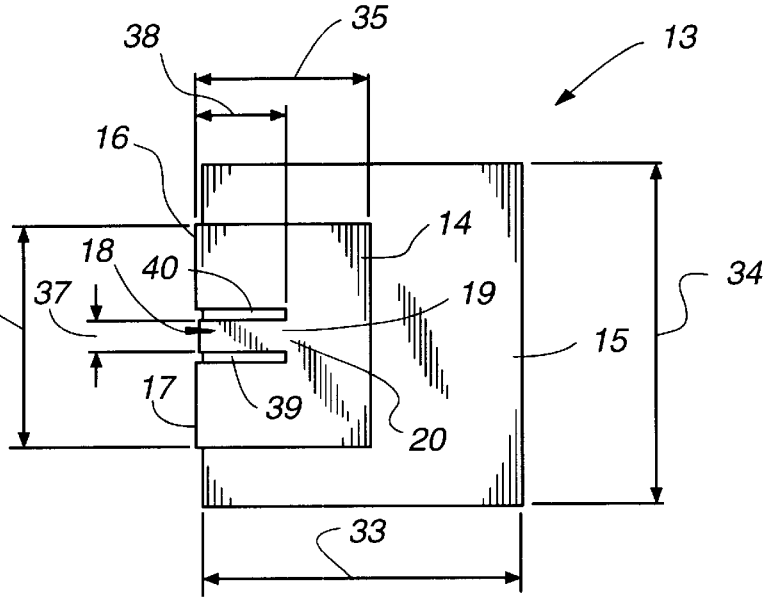
FIG. 2 is a top view of a quarter wave antenna that is formed by folding the FIG. 1 metal sheet along the two fold lines.
Figure 3:
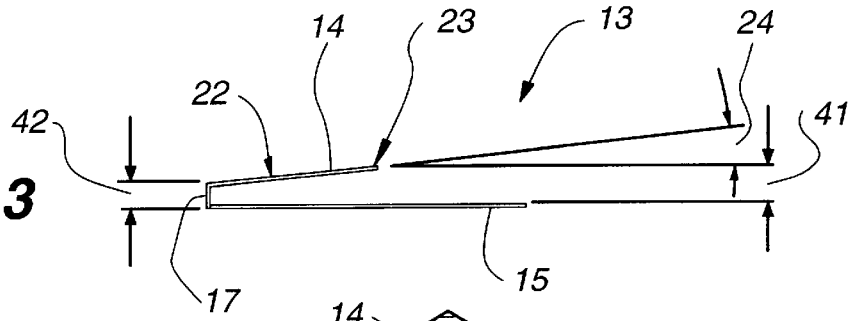
FIG. 3 is a side view of the quarter wave antenna of FIG. 2 showing that in this particular antenna, the FIG. 1 metal sheet has been folded so as to provide that the radiating element is inclined relative to the ground plane element.
Figure 3A:
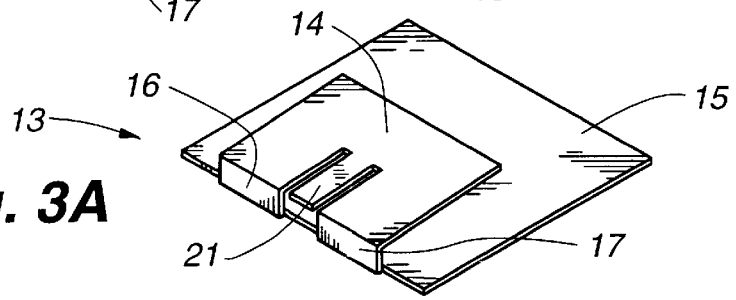
FIG. 3A is an isometric view of the antenna shown in FIGS. 2 and 3.

When metal sheet 10 is folded about fold lines 11, 12, the result is the antenna configuration shown in FIGS. 2 and 3. More specifically, FIG. 2 is a top view of a quarter wave antenna 13 that is formed by folding the FIG. 1 metal sheet 10 along the two fold lines 11, 12 to form what can be generally characterized as a U-shape. FIG. 3 is a side view of the quarter wave antenna 13 of FIG. 2.

While the present invention is not to be limited thereto, this invention finds utility where metal sheet 10 has been folded about fold lines 11, 12 so as to provide that the antenna's radiating element 14 is inclined relative to the antenna's ground plane element 15.

Figure 7:
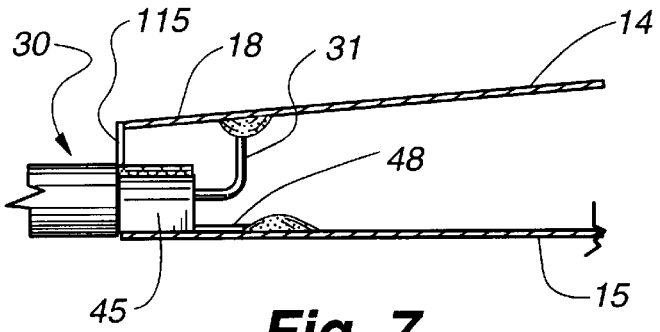
FIG. 7 is an enlarged and partially cutaway side view showing the assembly of FIGS. 5 and 6 soldered in place relative to the quarter wave antenna of FIGS. 2 and 3, and more specifically, the T-shaped metal conductor tab is soldered to the antenna's ground plane element and the cable's center conductor is soldered to the antenna's radiating element arm.
Figure 10:
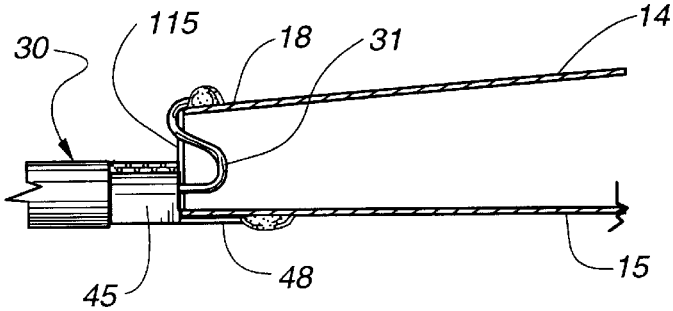
FIG. 10 is a view similar to FIG. 7, but FIG. 10 shows how the T-shaped metal conductor tab is soldered to the bottom surface of the antenna's ground plane element and how the cable's center conductor is soldered to the top surface of the antenna's radiating element arm.

In making an antenna 13, as shown in FIGS. 2 and 3, a flat metal sheet is formed so as to provide a unitary sheet 10 having a ground plane portion 15, a radiating portion 14, a first and second generally parallel, generally equal length, and physically spaced connecting portions 16/17 that connect ground plane portion 15 to radiating portion 14, and an extending tab 18 that extends from a generally central location of radiating element 14 in a direction toward ground plane portion 15, extending tab 18 having a free end 21 that is spaced from ground plane portion 15, to thereby define a gap 115 between the free end 18 of extending tab 18 and ground plane portion 15. As will be apparent, once the thus formed sheet 10 is bent, as shown in FIGS. 2, 3, 7, and 10, gap 115 provides for entry of a coaxial cable 30, as shown in FIGS. 7 and 10.

It should be noted that first and second connecting portions 16 and 17 having opposite ends that define two generally parallel fold lines 11/12, and that folding metal sheet 10 about these two generally parallel fold lines 11/12, so as to physically position radiating portion 14 and extending tab 18 over ground plane portion 15, places gap 115 in an operative position generally between ground plane portion 15 and radiating portion 14.

As shown by FIGS. 1–3, an antenna 13 in accordance with the spirit and scope of this invention is formed of a single sheet of generally planar metal 10 that is stamped, cut, or formed, and then bent, to provide four functional shapes in one unitary metal assembly. These four functional shapes comprise a ground plane element 15, a radiating element 14 that is physically spaced from, or above, radiating element 14, a two-section shorting element 16/17 that physically joins radiating element 14 and ground plane element 15 at the two generally parallel fold lines 11/12, and an arm 18 that has one fixed end 19 unitary with a generally central portion 20 of the radiating element 14, and has a free end 21 that extends toward, and generally terminates at, fold line 12.

While antenna 13 of FIGS. 2 and 3 has been shown as a quarter wave antenna, the spirit and scope of the present invention is not to be limited thereto. In addition, while radiating element 14 is shown as being of a smaller planar or physical size than ground plane element 15, it is within the spirit and scope of this invention to provide other radiator/ground plane size relationships.

Within antenna 13, radiating element 14 is oriented in a converging (i.e.,: non-parallel relation) to ground plane element 15. This non-parallelism allows the designer to match the impedance of antenna 13 to the antenna feed in/feed out cable (shown in FIGS. 5–9) very accurately and in a single piece construction.

Typically, the bandwidth of a microstrip antenna can be increased by increasing the dielectric space between radiating element 14 and ground plane element 15. Unfortunately, as this space increases, the antenna's feed inductance also increases. A mismatch between the antenna's impedance and the antenna's feed-in/feed-out conductor/cable causes a portion of the power applied to the antenna to be reflected back to the source, rather than being radiated into free space as desired, thus reducing the gain of the antenna.

This invention allows a designer to increase the antenna bandwidth without increasing the antenna feed impedance, a typical impedance being about 50 ohms. As a result, the antenna radiating power does not suffer. Bending metal sheet 10 about bend lines 11,12, so that radiating element 14 is placed in a non-coplanar position above ground plane element 15, as is best seen in FIG. 3, reduces the antenna feed inductance that is normally caused by elevating radiating element 14 above ground plane element 15. The incline of radiating element 14 is selected so as to result in a near ideal standing wave ratio (VSWR) of 1:1. A typical antenna in accordance with this invention provides nearly an ideal match, with nearly zero power reflected due to impedance mismatch.

As shown in FIG. 3, radiating element 14 is tilted so that its feed side 22 adjacent to fold line 11 is closer to ground plane element 15 than is the far side 23 of radiating element 14. The angle of tilt 24 of radiating element 14 relative to ground plane element 15 can range from a few degrees to nearly 90-degrees, wherein element 14 is essentially perpendicular to ground plane element 15. The greater tilt angle 24, the greater the bandwidth.

Figure 5:
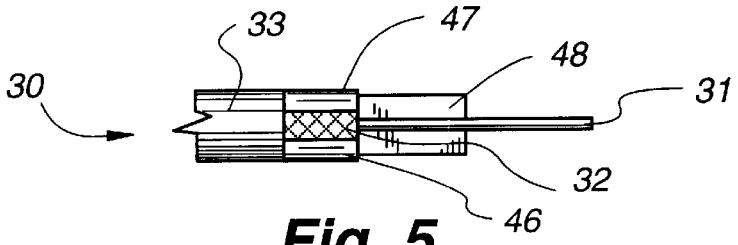
FIG. 5 is a top view of the T-shaped metal connector tab of FIG. 4, wherein the two T arms have been bent upward about the two fold lines, wherein the metal sheath of a coaxial cable has been placed between the two upward-extending T arms, and wherein the two T arms have been bent downward around the cable's metal sheath, whereby the T-shaped metal conductor tab is clamped to the cable's metal sheath, and then soldered in place.
Figure 6:
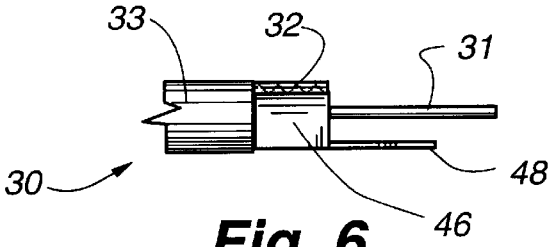
FIG. 6 is a side view of the assembly of FIG. 5.
Figure 8:
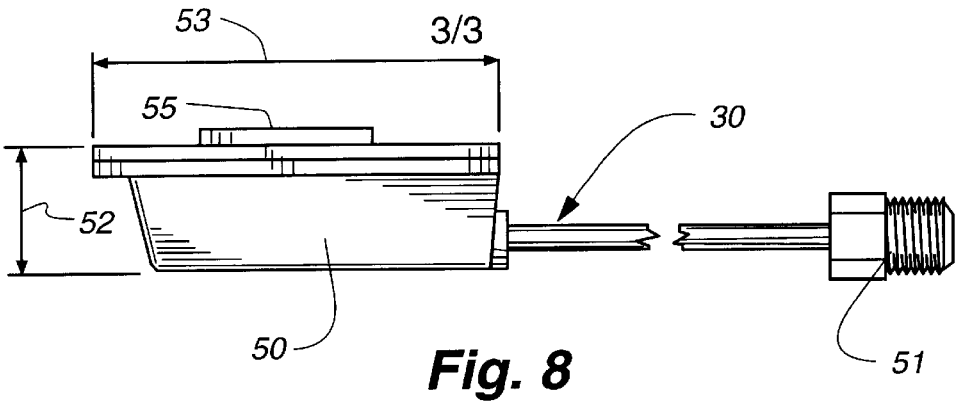
FIG. 8 is a side view of the assembly of FIG. 7, wherein a plastic radome is mounted onto the peripheral edges of the antenna's ground plane element, this view also showing a connector that is located on an end of the cable that is opposite to the antenna.
Figure 9:
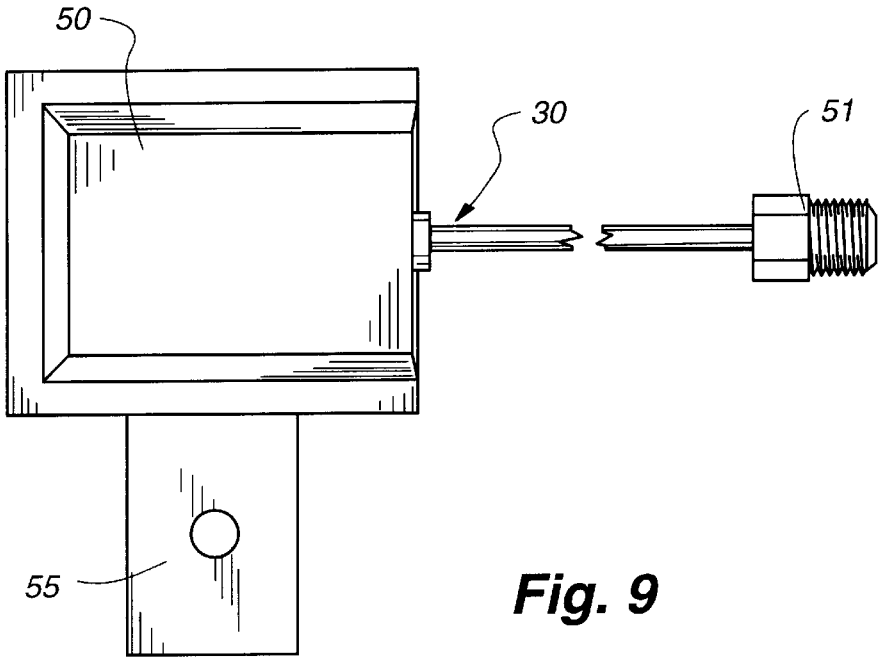
FIG. 9 is a top view of the assembly of FIG. 8, this view also showing a side-disposed assembly mounting tab.

The components of a completed antenna in accordance with this invention consist of (1) a unitary antenna 13 as shown in FIG. 3, (2) a feed in/feed out conductor, such as coaxial cable 30 shown in FIGS. 5, 6 and 7 having a center conductor 31, and a wire mesh sleeve or sheath 32, and (3) a radome as shown in FIGS. 8 and 9. As is conventional, an insulator sleeve 33 encases the outer periphery of cable 30, and another insulator sleeve separates inner conductor 31 from sheath 32.

While the dimensions of antenna 13 are not considered to be critical to the broader spirit and scope of this invention, in an embodiment of this invention. dimension 33 (see FIG. 2) was about 1.920-inch, dimension 34 was about 2.000-inch, dimension 35 was about 1.130 inch, dimension 36 was about 1.310, dimension 37 was about 0.200-inch, dimension 38 was about 0.600-inch, and the width of the two slots that form arm 18 was about 0.0600-inch. With reference to FIG. 3, dimension 41 was about 0.250-inch, and dimension 42 was about 0.160-inch.

Embodiments of this invention included antennas operating at about 1800 MHz and about 1900 MHz whose volume dimensions were about 2.50-inch by 2.50-inch by 0.75-inch, and an antenna operating at about 2400 MHz whose volume dimensions were about 2.00-inch by 2.25-inch by 0.40-inch.

In an embodiment of this invention, arm 18 extended coplanar with radiation element 14, as shown in FIG. 3. However, it is to be noted that the spirit and scope of this invention is not to be limited to this coplanar relationship. In fact, bending arm 18 out of this coplanar relationship can be instrumental in obtaining a desired impedance match.

Figure 4:
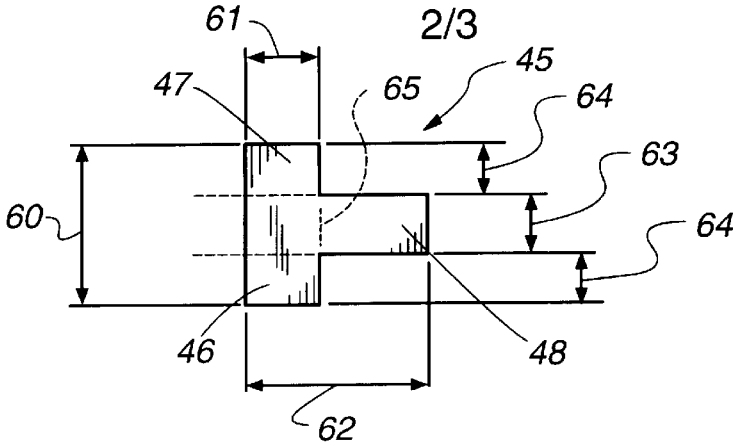
FIG. 4 is a top view of a T-shaped metal connector tab in accordance with the invention, wherein two parallel dotted lines define two fold lines.
Figure 4A:
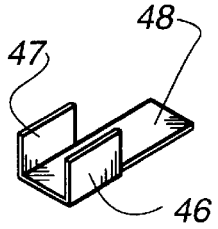
FIG. 4A is an isometric view of the T-shaped tab illustrated in FIGS. 4, 5, 6, and 7.

As a feature of this invention, when the antenna transmit/receive feed line comprises a coaxial cable 30, a flat T-shaped metal, preferably copper, connector tab 45 is provided as shown in FIG. 4. In this construction and arrangement, the cable's outer metal sheath 32 is connected to connector tab 45 by bending the two T arms 46, 47 of the T-shape around metal sheath 32, and then securing connector tab 45 to sheath 32, preferably both by a clamping action and by the use of solder or the like, this being shown in FIGS. 5 and 6.

As perhaps best seen in FIG. 6, the extending leg 48 of T-shaped connector tab 45 is now available for securing (such as by soldering, welding, mechanical connection, etc.) to the top surface or to the bottom surface of ground plane element 15, as the cable's center conductor 31 is available for securing to the top surface or to the bottom surface of arm 18 that is formed integrally with radiating element 14.

With reference to FIG. 4, in an embodiment of the invention, but without limitation thereto, dimension 60 of T-shaped connector tab 45 was about 0.50-inch, dimension 61 was about 0.25-inch, dimension 62 was about 0.55-inch, dimension 63 was about 0.18-inch. dimensions 64 were each about 0.16-inch, and the extending leg 48 of T-shaped connector tab 45 was bent downward about dotted line 65 about 0.025-inch, such that leg 48 extended generally parallel to the unbent plane of arms 46/47.

FIG. 7 is an enlarged and partially cutaway side view showing the assembly of FIGS. 5 and 6 soldered in place relative to the quarter wave antenna of FIGS. 2 and 3. More specifically, the extending leg 48 of T-shaped connector tab 45 is soldered to the top surface of the antenna's ground plane element 15 and the cable's center conductor 31 is soldered to the bottom surface of the arm 18 that is formed integrally with the antenna's radiating element 14.

FIG. 10 is a view similar to FIG. 7, but FIG. 10 shows how the extending leg 48 of the T-shaped metal connector tab 45 is soldered to the bottom surface of antenna's ground plane element 15, whereas the cable's center conductor 31 is soldered to the top surface of the arm 18 that is formed integrally with antenna's radiating element 14.

FIG. 8 is a side view of the assembly of FIG. 7, wherein a plastic radome 50 is mounted onto the peripheral edges of the antenna's ground plane element 15. FIG. 8 also shows an electrical connector 51 that is located on the end of cable 30 that is opposite to radome 50. In an embodiment of the invention, but without limitation thereto, dimension 52 was about 0.56-inch, dimension 53 was about 2.21-inch, and cable 30 was about 12 feet long.

FIG. 9 is a top view of the assembly of FIG. 8. This view also shows a side disposed plastic mounting tab 55 that is used to mount the antenna/radome combination in an operating position.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. A method of making an antenna having a radiating element and a ground plane element, comprising the steps of:

providing a flat metal sheet;

forming said flat metal sheet to provide a unitary metal sheet having a ground plane portion, a radiating portion, a first and a second generally parallel, generally equal length, and physically spaced connecting portions that connect said ground plane portion to said radiating portion, and an extending tab that extends from a generally central location of said radiating portion in a direction toward said ground plane portion, said extending tab having a free end that is spaced from said ground plane portion to define a gap between said free end of said extending tab and said ground plane portion;

said first and second connecting portions having opposite ends that define two generally parallel fold lines; and bending said flat metal sheet about said two generally parallel fold lines so as to physically position said radiating portion and said extending tab over said ground plane portion.

2. The method of claim 1 including the steps of:

providing a cable having a first and a second conductor;

connecting said first conductor to said ground plane portion; and connecting said second conductor to said extending tab.

3. The method of claim 2 wherein said cable is a coaxial cable, wherein one end of said coaxial cable is aligned with said gap, wherein said first conductor is an exposed sheath at said one end of said coaxial cable, and wherein said second conductor is an exposed center conductor at said one end of said coaxial cable.

4. The method of claim 3 wherein said exposed sheath is connected to a surface of said ground plane portion that faces said radiating portion, and wherein said exposed center conductor is connected to a surface of said extending tab that faces said surface of said ground plane portion.

5. The method of claim 3 including the steps of:

providing a T-shaped metal connecting tab having a leg portion and a top disposed T-portion;

positioning said T-shaped metal connecting tab adjacent to said one end of said coaxial cable such that said top disposed T-portion coincides with said exposed sheath, and so that said leg portion of said T-shaped connecting tab is spaced from and extends parallel to said exposed center conductor;

bending said top disposed T-portion about, and in physical engagement, with said exposed sheath, to thereby mechanically and electrically connect said top disposed T-portion to said exposed sheath;

electrically connecting said leg of said T-shaped connecting tab to said ground plane portion; and connecting said exposed center conductor to said extending tab.

6. The method of claim 5 including the steps of:

providing a radome to encase said bent metal sheet, said one end of said coaxial cable, and said T-shaped metal connecting tab; and providing an external mounting tab on said radome.

7. The method of claim 1 wherein said step of bending said flat metal sheet about said two generally parallel fold lines, so as to physically position said radiating portion and said extending tab over said ground plane portion, results in said radiating portion extending in a plane that is generally parallel to a plane occupied by said ground plane portion.

8. The method of claim 7 including the steps of:

providing a cable having a first and a second conductor;

connecting said first conductor to said ground plane portion; and connecting said second conductor to said extending tab.

9. The method of claim 1 wherein said step of bending said flat metal sheet about said two generally parallel fold lines, so as to physically position said radiating portion and said extending tab over said ground plane portion, results in said radiating portion occupying a plane that is inclined to a plane occupied by said ground plane portion.

10. The method of claim 9 wherein said plane that is occupied by said radiating portion is inclined in a direction such that said gap defines a closest distance from said radiating portion to said ground plane portion.

11. The method of claim 10 including the steps of:

providing a cable having a first and a second conductor;

connecting said first conductor to said ground plane portion; and connecting said second conductor to said extending tab.

12. An antenna assembly comprising:

a one piece metal sheet having a generally planar ground plane element, a generally planar radiating element, a first and a second generally parallel, generally equal length, physically spaced, and generally planar support arms, each of said support arms having a first end formed integrally with said ground plane element, each of said support arms having a second end formed integrally with said radiating element, said first and second support arms operating to support said radiating element physically spaced from said ground plane element, and a connection tab formed integrally with said radiating element and extending from an internal area of said radiating element in a direction toward said second ends of said support arms, said connection tab having a free end that is spaced from said ground plane element to define an open gap that exists between said first and second support arms and said ground plane element; and a feed cable having one end that includes a first conductor electrically that is connected to said ground plane element and a second conductor that is electrically connected to said connection tab.

13. The antenna assembly of claim 12 wherein said feed cable comprises a coaxial cable, wherein one end of said coaxial cable is aligned with said open gap, wherein said first conductor comprises a metal sheath at said one end of said coaxial cable, and wherein said second conductor is a metal center conductor at said one end of said coaxial cable.

14. The antenna assembly of claim 13 wherein said metal sheath is electrically connected to a surface of said ground plane element that faces said radiating element, and wherein said center conductor is electrically connected to a surface of said connection tab that faces said surface of said ground plane element.

15. The antenna assembly of claim 13 including:

a metal tab having a leg portion and a T-portion; said T-portion being physically and electrically connected to said metal sheath, and said leg portion being physically spaced from said center conductor and electrically connected to said ground plane element.

16. The antenna assembly of claim 15 including;

a plastic radome covering said one piece metal sheet, said one end of said coaxial cable, and said metal tab.

17. The antenna assembly of claim 12 wherein said radiating element extends in a plane that is generally parallel to a plane that is occupied by said ground plane element.

18. The antenna assembly of claim 17 including:

a cable having a first conductor connected to said ground plane element and having a second conductor connected to said connection tab.

19. The antenna assembly of claim 12 wherein said radiating element occupies a plane that is inclined to a plane that is occupied by said ground plane element.

20. The antenna assembly of claim 19 wherein said plane that is occupied by said radiating element is inclined in a direction such that said open gap defines a closest distance from said radiating element to said ground plane element.

21. The antenna assembly of claim 20 including:

a cable having a first conductor connecting to said ground plane element and having a second conductor connected to said connection tab.

* * * * *